United States Patent [19]

Kawai et al.

[11] Patent Number: 4,983,127

[45] Date of Patent: Jan. 8, 1991

[54] ELECTRICAL CONNECTOR

[75] Inventors: Mitsuru Kawai; Masaru Yoshida; Yoshihiro Sasaki, all of Tokyo, Japan

[73] Assignee: Hirose Electric Co., Ltd., Tokyo, Japan

[21] Appl. No.: 407,626

[22] Filed: Sep. 15, 1989

[30] Foreign Application Priority Data

Oct. 4, 1988 [JP] Japan ..... 63-129622[U]

[51] Int. Cl.[5] ..... H01R 9/09

[52] U.S. Cl. ..... 439/79; 439/95; 439/607; 439/609; 439/903

[58] Field of Search ..... 439/76, 79–83, 439/95, 607, 609, 903

[56] References Cited

U.S. PATENT DOCUMENTS 4,637,669 1/1987 Tajima ..... 439/95
4,722,691 2/1988 Gladd et al. ..... 439/79

FOREIGN PATENT DOCUMENTS 61-184285 11/1986 Japan .

*Primary Examiner*—Paula A. Bradley
*Attorney, Agent, or Firm*—Kanesaka & Takeuchi

[57] ABSTRACT

An electrical connector includes an insulating housing (100) consisting of a front section (111) and a rear section (112), the front section having a cylindrical contact support section (120) with a plurality of contact apertures (121) extending along its longitudinal axis and the rear section having a rear cavity (119) in a lower portion thereof; a plurality of L-shaped contact elements (300) each having a contact portion (301), an intermediate portion (302) extending rearwardly from the contact portion, and a terminal portion (303) extending downwardly from the intermediate portion, the contact portion being fitted into the contact aperture; and a block member (200) having a plurality of lateral channels (201) for receiving the intermediate portions and a plurality of vatical apertures (202) for receiving the terminal portions, the block member being fitted into the rear cavity so that the intermediate and terminal portions are fitted into the lateral channels and the vertical apertures respectively.

5 Claims, 2 Drawing Sheets

ELECTRICAL CONNECTOR

BACKGROUND OF THE INVENTION

The present invention relates to electrical connectors having an insulating housing and L-shaped contact elements, the terminal portions of which are connected to the electrical circuit of a printed circuit board.

An electrical connector of the type is described in Japanese U.M. Patent Application Kokai No. 61-184285 which has been assigned to the same assignee as in this application. The electrical connector has an insulating housing and L-shaped contact elements supported by the insulating housing. However, the bent portions between the front contact portions and the rear terminal portions are exposed to the atmosphere. In addition, the metal shield fitted in the insulating housing to enclose the contact portions is semi-cylindrical.

The above electrical connector has the following disadvantages.

(1) The bent portions of contact elements are exposed because the metal shield makes it difficult to protect those portions. Consequently, dirt and dust accumulate between respective contact elements causing poor insulation or short circuit. In addition, a foreign object can strike and deform contact elements. Moreover, the exposed contact portion produces electromagnetic interference.

(2) The attachment members of the metal shield are not sufficient to prevent play within the insulating housing so that when a mating connector is plugged in and out repeatedly, the plugging force is transmitted to the insulating housing. The plugging force is further transmitted to the connection portions, causing a crack in the soldered joint, resulting in separation.

SUMMARY OF THE INVENTION

Accordingly, it is an object of the invention to provide an electrical connector in which the bent portions of contact elements are protected electrically and mechanically.

In accordance with the invention the above object is accomplished by an electrical connector which includes an insulating housing, a metal hood member, and a plurality of contact elements mounted within the insulating housing, characterized in that the contact element has a contact portion for contact with a mating contact element within the insulating housing, an intermediate portion extending rearwardly from the contact portion, and a terminal portion extending downwardly from the intermediate portion through the insulating housing; the insulating housing has an annular recess for receiving a mating shell member, a rear cavity for receiving a block member for supporting the intermediate portions of contact elements within the hood member; the hood member has a pair of leg members to be connected to a ground circuit on a printed circuit board and a pair of flanges extending inwardly from lower edges thereof for supporting the block member; and that the block member has lateral channels for receiving the intermediate portions of contact elements and vertical apertures through which the terminal portions of contact elements are pass.

The block member is fitted into the rear cavity of the insulating housing such that the terminal portions and the intermediate portions of contact elements are supported by the contact apertures and the lateral channels thereof. Thus, the contact elements are completely covered over the entire length so that not only adherence to the contact elements of dirt and dust but also deformation of the contact elements by an external force are prevented.

Other objects, features, and advantages of the invention will be apparent from the following description when taken in conjunction with the accompanying drawings.

DESCRIPTION OF THE PREFERRED EMBODIMENT

Figure 1:
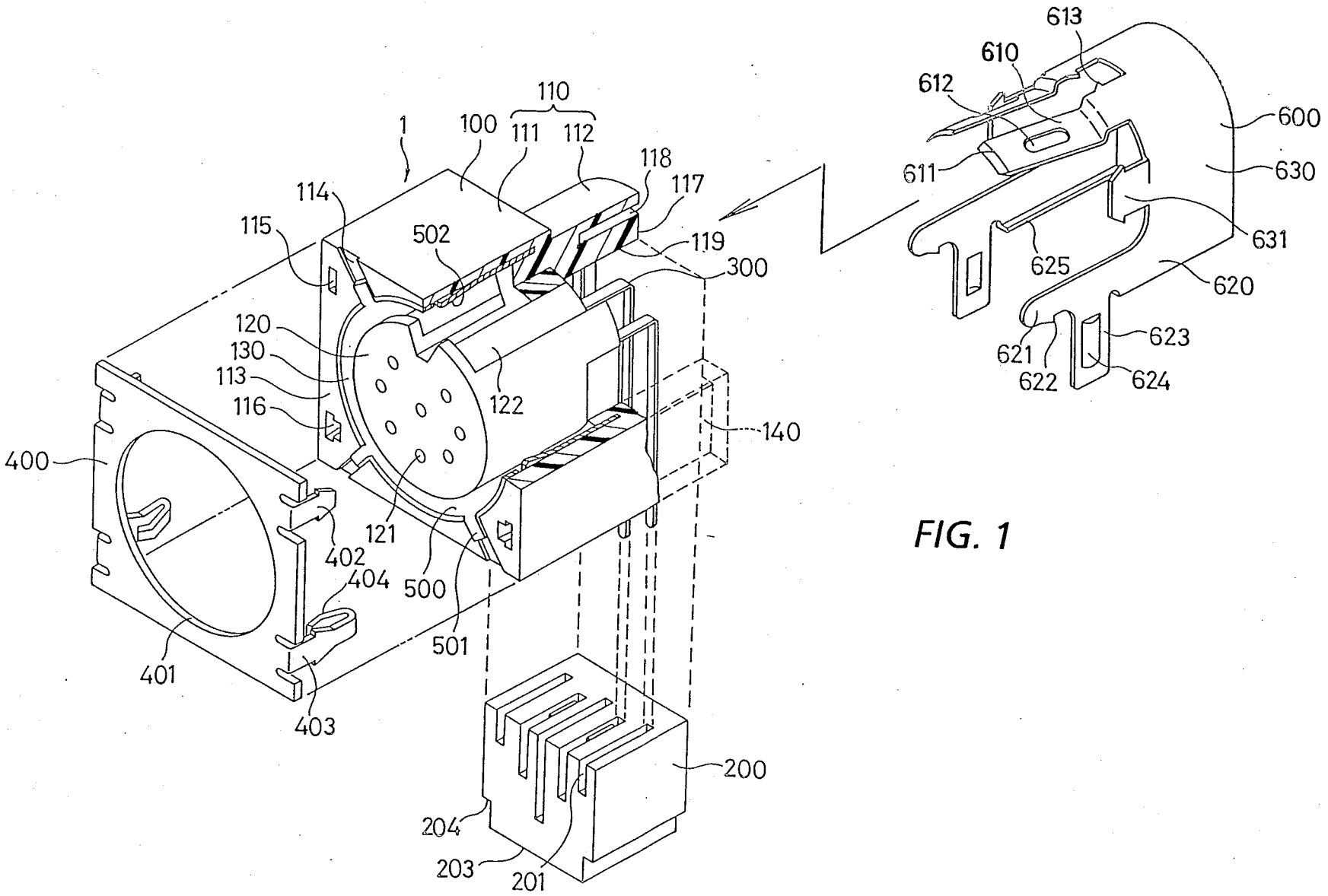
FIG. 1 is an exploded, partially cutaway, perspective view of an electrical connector according to an embodiment of the invention.

In FIG. 1, the electrical connector 1 includes an insulating housing 100, a block member 200, contact elements 300, an end face protection member 400, a cylindrical shield member 500, and a metal hood member 600.

The insulating housing 100 is molded from an insulating material, such as a plastic, so as to have an annular recess 130 between a cylindrical contact support 120 and a housing body 110. The housing body 110 consists of a cubic front section 111 and a U-shaped rear section 112. Four radial seats 114 are provided on the front surface 113 of the front section 111 corresponding to the engaging or contact lugs 501 of the cylindrical shield member 500. A pair of latch slots 115 are provided on the upper corners of the front surface 113 to receive latch lances 402 of the end face protection member 400. A pair of T-shaped latch slots 116 are provided on the lower corners of the front surface 113 to receive latch lances 403 with a U-shaped contact 404 extending therefrom. The T-shaped latch slots 116 communicate with attachment slots 140 extending forward from the rear end so that the contacts 404 of the end face protection member 400 are connected electrically and mechanically to the contact portions 621 of the metal hood member 600.

The insulating housing 100 has a U-shaped recess 118 extending forward from the rear end 117 for receiving the rear portion of the hood member 600. This recess 118 communicates with a latch groove (not shown) into which projections 613 are pushed to secure the hood member 600 to the insulation housing 100. A rear cavity 119 is provided on the lower portion of the rear section 112 to receive the block member 200.

A number of contact apertures 121 are provided in the contact support 120 for supporting the contact sections 301 of contact elements 300. A pair of elongated indentations 122 are provided on the circumferential surface of the contact support 120 to receive the elongated contacts 610 of the hood member 600. These indentations communicate with the U-shaped recess 118. The annular recess 130 extends rearwardly from the front surface to receive the cylindrical shield member 500 and the shell member of a mating connector (not shown).

The block member 200 is molded from a dielectric material, such as a plastic, so as to have lateral channels 201 for receiving intermediate sections 302 of the contact elements 300 and a vertical apertures 202 for receiving connection sections 303 extending downwardly from the intermediate sections 302. Stepped lower edges 204 provided on opposite ends of a lower surface 203 of the block member 200 engage lower flanges 625 of the hood member 600.

Figure 2:
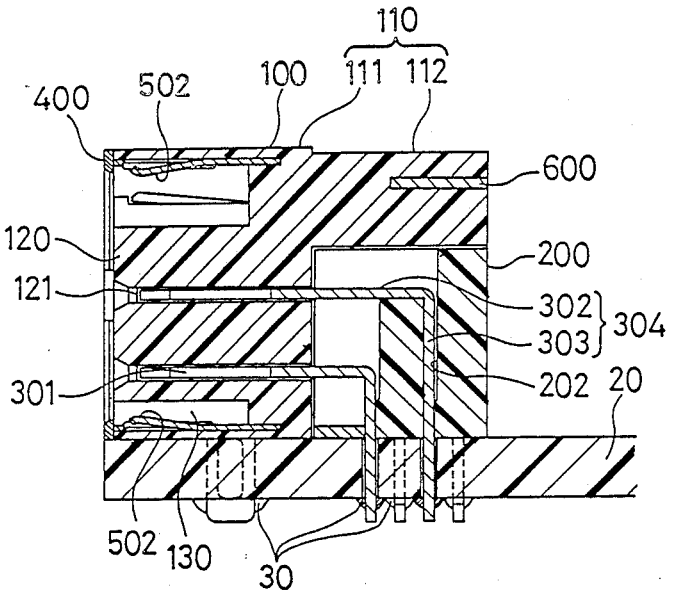
FIG. 2 is a sectional view of the electrical connector mounted on a printed circuit board.

As best shown in FIG. 2, each contact 300 is made by stamping and forming a spring conductive metal sheet so as to have the front contact section 301 for contact with the contact of a mating connector and the rear connection section 304 consisting of the intermediate section 302 extending rearwardly from the front contact section and the terminal section 303 extending downwardly from the intermediate section.

The end face protection member 400 is made by stamping and forming a thick metal plate so as to have a circular opening 401 at the center to receive the shell member of a mating connector. It has a square shape substantially identical with the front surface 113 of the insulating housing 100. A pair of latch lances 402 and a pair of latch lances 403 with a U-shaped contact 404 extend rearwardly from the upper and lower portions of the end face protection member 400, respectively.

The cylindrical shield member 500 is made by stamping and forming a spring metal thin sheet. Four engaging lugs 501 extend outwardly from the front edge of the shield member 500 in radial directions and rest in the radial seat 114 on the front end of the insulating housing 100. A plurality of cantilever contacts 502, which extend forwardly and inwardly, are provided on the circumferential surface of the shield member 500.

Like the shield member 500, the hood member 600 is made by stamping and forming a spring metal thin sheet to have a pair of elongated contacts 610 and a pair of attachment sections 620. The elongated contact 610 has a slightly inwardly bent free end 611 for shield contact with the metal shield (not shown) provided on the inside of a mating shell member. An opening 612 is provided behind the free end 611 to enhance the spring property of the elongated contact 610. A projection 613 is provided at the inside edge of the rear portion of elongated contact 610 to prevent the metal hood member from falling off from the insulating housing.

The attachment section 620 and the elongated contact 610 are integrated with a link section 630. A pair of latch lances 631 extend forwardly from the front edge of the link section 630 to be pushed into latch slots (not shown) of the insulating housing 100. A contact portion 621 extends forwardly from the attachment section 620 to be inserted into the attachment slot 140 of the insulating housing 100 for contact with the contact 404 of the end face protection member 500. A projection 622 is provided on the lower edge of the contact portion 621 to prevent the contact portion from falling off from the attachment slot 140.

A leg member 623 extends downwardly from the attachment section 620 to be inserted into a mounting slot of the printed circuit board 20 and has a projection 624 to engage the mounting slot. This leg member 623 is secured with solder 30 to the ground circuit of a printed circuit board 20. A pair of flanges 625 extend inwardly from the lower edges of the attachment section 620 to engage with the stepped lower edges 204 of the block member 200 for support.

The electrical connector is assembled as follows.

(1) The contact portions 301 of L-shaped contacts 300 are inserted into the respective contact holes 121 on the rear section 112 of the insulating housing 100, while the cylindrical shield member 500 is inserted into the annular recess 130 on the front section 111 of the insulating housing 100.

(2) The end face protection member 400 is then attached by pushing the latch lances 402 and 403 into the respective latch slots 115 and 116. As best shown in FIG. 1, the block member 200 is fitted into the lower rear cavity 119 of the rear housing section 112 such that the terminal portions 303 of the contact elements 300 pass through the vertical apertures 202 and the intermediate portions 302 are fitted into the lateral channels 201.

Figure 3:
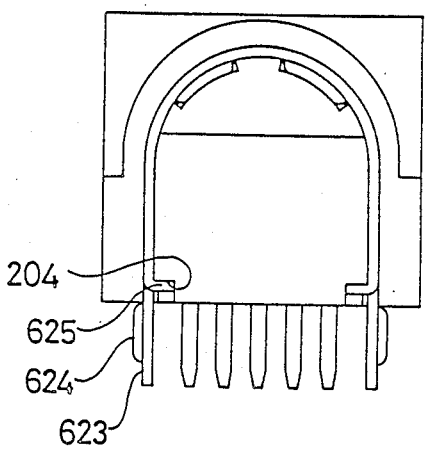
FIG. 3 is a rear view of the electrical connector.

(3) The metal hood member 600 is then joined to the insulating housing 100 so that the block member 200 is supported by the flanges 625 of the metal hood member 600 (FIG. 3).

(4) The electrical connector is then mounted on the printed circuit board 20 so that the terminal portions 303 of contacts 300 and the leg members 623 of the hood member 600 are soldered to the respective signal and ground circuits provided on the back of the board 20.

Figure 4:
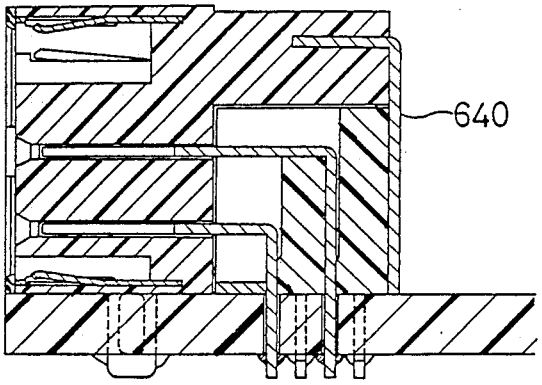
FIG. 4 is a sectional view of an electrical connector according to another embodiment of the invention.

FIG. 4 shows an electrical connector according to another embodiment of the invention. The metal hood member 600 has a back plate 640 to enhance the shield effect. The other portions are the same as those of the hood member described above.

The terminal portions of L-shaped contacts are protected by the block member so that adherence to the contacts of dust and dirt is prevented whereby poor insulation and short circuit are prevented. An impact by an external object is blocked whereby deformation of the terminal portions is prevented. The metal hood encloses the terminal portions and enhances the electromagnetic interference protection. Moreover, repeated plugging in and out of a mating connector applies no or little load to the soldered joint so that there is little danger that the solder comes off from the board.

We claim:

1. An electrical connector comprising an insulating housing, a metal hood member, and a plurality of contact elements mounted within said insulating housing, characterized in that said contact elements have a contact portion for contact with a mating contact element within said insulating housing, an intermediate portion extending rearwardly from said contact portion, and a terminal portion extending downwardly from said intermediate portion through said insulating housing;

said insulating housing has an annular recess for receiving a mating shell member, a rear cavity for receiving a block member for supporting said intermediate portions of contact elements within said hood member;

said hood member has a pair of leg members to be connected to a ground circuit on a printed circuit board and a pair of flanges extending inwardly from lower edges thereof for supporting said block member; and that said block member has lateral channels for receiving said intermediate portions of contact elements and vertical apertures through which said terminal portions of contact elements are pass.

2. An electrical connector comprising:

an insulating housing consisting of a front section and a rear section said front section having a cylindrical contact support portion with a plurality of contact apertures extending along its longitudinal axis and said rear section having attachment slots in a lower portion thereof and a U-shaped recess in an upper portion thereof;

a plurality of L-shaped contact elements each having a contact portion fitted into said contact aperture, an intermediate portion extending rearwardly from said contact portion, and a terminal portion extending downwardly from said intermediate portion;

a block member having a plurality of lateral channels for receiving said intermediate portions and a plurality of vertical apertures for receiving said terminal portions, said block member being fitted into a rear cavity so that said intermediate and terminal portions are fitted into said lateral channels and said vertical apertures respectively; and a metal hood member having a U-shaped link section fitted into said U-shaped recess of said insulation housing, a pair of elongated contacts extending forwardly from an upper portion of said link section for contact with a mating connector plug; and a pair of attachment portions extending forwardly from a lower portion of said link section and having a downwardly extending leg for contact with a ground of a printed circuit board.

3. The electrical connector of claim 2, wherein said hood member has a pair of flanges extending inwardly from a lower edge of said attachment section and said block member has a pair of stepped lower edges such that when said hood member is joined to said insulating housing, said flanges engage said lower edges to support said block member.

4. The electrical connector of claim 2, wherein said metal hood member has a back plate for covering an entire back side of said block member so as to enhance its shielding effects.

5. An electrical connector comprising:

an insulating housing consisting of a front section and a rear section, said front section having an annular recess extending rearwardly from a front face of said front section, at least one radial seat radially extending from said annular recess on said front face, and a pair of T-shaped latch slots extending rearwardly from a lower portion of said front face and said rear section having a pair of attachment slots extending forwardly from a lower end portion of said rear section to communicate with said T-shaped latch slots;

a cylindrical shield member fitted in said annular recess and having at least one contact lug resting on said radial seat;

an end face protection member having a pair of latch lances with a U-shaped contact, which extend rearwardly from a lower portion thereof and fitted into said T-shaped latch slots for securing said end face protection member to said insulating housing such that said contact lug is brought into contact with said end face protection member; and a metal hood member having a U-shaped link section and a pair of attachment sections extending forwardly from a lower portion of said link section and having a contact portion at its free end such that when said attachment sections are fitted into said attachment slots, said contact portions are brought into contact with said U-shaped contacts of said end face protection member, thereby completing electrical continuity from said cylindrical shield member to said end face protection member to said hood member.

* * * * *